US007070447B1

(12) United States Patent
Montena

(10) Patent No.: US 7,070,447 B1
(45) Date of Patent: Jul. 4, 2006

(54) COMPACT COMPRESSION CONNECTOR FOR SPIRAL CORRUGATED COAXIAL CABLE

(75) Inventor: Noah Montena, Syracuse, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 11/260,428

(22) Filed: Oct. 27, 2005

(51) Int. Cl.
*H01R 9/05* (2006.01)

(52) U.S. Cl. ..... 439/578; 439/584

(58) Field of Classification Search ..... 439/578, 439/583, 584, 840, 841
See application file for complete search history.

(56) References Cited

U.S. PATENT DOCUMENTS

| | | | | |
|---|---|---|---|---|
| 4,824,400 | A * | 4/1989 | Spinner | 439/578 |
| 4,995,832 | A | 2/1991 | Thommen et al. | |
| 5,120,260 | A | 6/1992 | Jackson | |
| 5,137,470 | A | 8/1992 | Doles | |
| 5,154,636 | A | 10/1992 | Vaccaro et al. | |
| 5,167,533 | A | 12/1992 | Rauwolf | |
| 5,267,877 | A | 12/1993 | Scannelli et al. | |
| 5,322,454 | A * | 6/1994 | Thommen | 439/584 |
| 5,334,051 | A | 8/1994 | Devine et al. | |
| 5,435,745 | A | 7/1995 | Booth | |
| 5,766,037 | A * | 6/1998 | Nelson | 439/583 |
| 5,802,710 | A | 9/1998 | Bufanda et al. | |
| 5,997,350 | A | 12/1999 | Burris et al. | |
| 6,080,015 | A | 6/2000 | Andreescu | |
| 6,471,545 | B1 | 10/2002 | Hosler, Sr. | |
| 6,848,941 | B1 | 2/2005 | Wlos et al. | |
| 2004/0219821 | A1 | 11/2004 | Makita et al. | |
| 2005/0026496 | A1 | 2/2005 | Islam et al. | |
| 2006/0014427 | A1 * | 1/2006 | Islam et al. | 439/578 |

* cited by examiner

*Primary Examiner*—Tho D. Ta
*Assistant Examiner*—Vanessa Girardi
(74) *Attorney, Agent, or Firm*—Wall Marjama & Bilinski LLP

(57) ABSTRACT

A compression connector for the end of a spiral corrugated coaxial cable is provided wherein one or more contact forces are provided between the connector and the cable by driving a coiled element of the connector into a groove within the corrugations of the cable and/or by causing an element of the compression connector to radially deform inward against the outer jacket of the cable.

26 Claims, 6 Drawing Sheets

COMPACT COMPRESSION CONNECTOR FOR SPIRAL CORRUGATED COAXIAL CABLE

FIELD OF THE INVENTION

This invention relates in general to terminals for coaxial cables, and, more particularly, to compact compression connectors for use with spiral corrugated coaxial cables.

BACKGROUND OF THE INVENTION

Coaxial cable is being deployed on a widespread basis in order to carry signals for communications networks, e.g., CATV and computer networks. All types of coaxial cable must at some point be connected to network equipment ports. In general, it has proven difficult to correctly make such connections without requiring labor intensive effort by highly skilled technicians. Moreover, even if careful attention is paid during installation, there still can be installation errors, which, in turn, can moderately to several affect signal quality.

These generalized installation problems are likewise encountered with respect to spiral corrugated coaxial cable (i.e., cable that is often referred to in the art as "Superflex" cable), which, however, also poses its own set of unique issues. Spiral corrugated coaxial cable is a special type of coaxial cable that is utilized in situations where it is necessary for the cable to be rotation resistant and/or highly flexible.

Unlike standard coaxial cable, the spiral corrugated variety has an irregular outer surface. That, in turn, makes it difficult for those in the art to design connectors or connection techniques for engagement of the spiral corrugated coaxial cable in a manner that provides a high degree of mechanical stability, electrical shielding and environmental sealing yet that also is not physically damaging the irregular outer surface of the cable.

In an effort to overcome this difficulty, some in the art have opted to utilize a soldering technique in order to join spiral corrugated coaxial cable to a connector. Although this methodology generally ensures that reliable mechanical and electrical connections are achieved, it also necessitates usage of highly specialized, unwieldy soldering equipment as well as the dedication of trained manpower to perform the soldering. Consequently, soldering has emerged as a realistic option only for assembling factory-made jumpers, not for joining spiral corrugated coaxial cable to connectors in a field installation setting.

Another current approach to overcoming this difficulty is to utilize a connector that makes contact with the conductive outer wall of the spiral corrugated coaxial cable through a thread-like internal protrusion shaped to substantially match the pitch and groove width of the corrugations of the spiral corrugated coaxial cable. The connector is screwed onto the cable, which is then drawn tight against the internal thread protrusion as it bottoms on a stop within the connector. The spiral corrugated coaxial cable is then held in place within the connector through use of a secondary clamping device, which clamps onto an exterior portion of the cable (e.g., the corrugated outer wall, the outer jacket).

This approach has several benefits, such as the fact that it can be utilized in either a factory or field installation setting. However, these benefits are more than overshadowed by various drawbacks, most notably the unreliability of the technique. For example, the shielding that is achieved by contact forces created between the thread protrusion of the connector and the outer wall of the spiral corrugated coaxial cable can degrade over time. Moreover, in order for the thread protrusion to be installable on the spiral corrugated coaxial cable there must be some clearance between it and the cable, and the only interference between the cable and the connector exists as a result of contact force generated by bottoming the cable in the connector against the course pitch threads of the cable and protrusion. However, the contact force can become relaxed over time, due to one or more common conditions such as temperature fluctuations, vibrations, and flexure of the cable relative to the connector. And if the contact force becomes relaxed, then the necessary interference is negated and, in turn, the connection between the cable and the connector is lost.

Thus, there is a need for a connector for spiral corrugated coaxial cables that is simple to install, is reliably effective at establishing and maintaining both electrical and mechanical engagement to the spiral corrugated coaxial cable, and that does not suffer from the aforementioned problems that have plagued previous connectors and connection techniques in the art.

SUMMARY OF THE INVENTION

These and other needs are met by the present invention, which provides a compression connector for coaxial cable. By way of non-limiting example, the coaxial cable can be spiral corrugated coaxial cable that has a center conductor surrounded by a dielectric layer, which, in turn, is surrounded by a plurality of conductive corrugations. A groove (e.g., a continuous groove) is defined between the corrugations, wherein the corrugations are at least partially surrounded by a protective outer cable jacket. The connector of the present invention can be advantageously utilized with spiral corrugated coaxial cable because the connector provides strong contact forces against the cable, yet is simple and effective to utilize in either factory or field installation settings.

In accordance with an exemplary aspect of the present invention, the compression connector comprises a body defining an internal passageway and including a proximal end and a distal end. A compression member (e.g., sleeve) of the connector also has a proximal end (which can be flanged) and a distal end, wherein its distal end is in tactile communication with the body. A coiled element is located within the internal passageway of the body and is adapted for engagement within the groove of the spiral corrugated coaxial cable, wherein a clamping element is in communication with the coiled element. To connect the connector and the cable, the compression member is slidingly advanced such that the clamping element is caused to be compressed radially to an extent whereby the coiled element is driven into the groove of the spiral corrugated coaxial cable so as to provide at least one contact force between the compression connector and the spiral corrugated coaxial cable.

In accordance with this exemplary aspect (and, if desired, other aspects) of the present invention, at least a portion of the body is tapered and at least a portion of the clamping element has a substantially matching taper. Also, the distal end of the body can include other connector interfaces including, but not limited to, a BNC connector, a TNC connector, an F-type connector, an RCA-type connector, a DIN male connector, a DIN female connector, an N male connector, an N female connector, an SMA male connector and an SMA female connector.

In further accordance with this exemplary aspect (and, if desired, other exemplary aspects) of the present invention, the clamping element includes an internal bore having a predetermined diameter, wherein the coiled element is at least partially disposed within the internal bore. The clamping element can further include a first end, a second end, and a discontinuity area between the first end and the second end, wherein the discontinuity area is reduced as the clamping element is compressed radially. That, in turn, causes the diameter of the internal bore to be reduced to an extent whereby the coiled element is caused to be driven into the groove of the spiral corrugated coaxial cable so as to provide at least one contact force between the compression connector and the spiral corrugated coaxial cable.

In still further accordance with this exemplary aspect (and, if desired, other exemplary aspects) of the present invention, the compression connector can further comprise a grommet, which is in tactile communication with the proximal end of the compression member and which can be made of rubber or another material. Upon sliding advancement of the compression member, the grommet is compressed radially or caused to be compressed radially against the outer jacket of the spiral corrugated coaxial so as to provide a contact force between the compression connector and the spiral corrugated coaxial cable.

In yet still further accordance with this exemplary aspect (and, if desired, other exemplary aspects) of the present invention, the compression connector can further comprise a driving member (e.g., a washer), which is located between a shoulder of the compression member and the clamping element. Upon sliding advancement of the compression member, the shoulder of the compression member contacts and applies sufficient axial force to the driving member such that the driving member contacts the clamping element and causes the clamping element to be compressed radially to an extent whereby the coiled element is driven into the groove of the spiral corrugated coaxial cable so as to provide at least one contact force between the compression connector and the spiral corrugated coaxial cable.

In yet still even further accordance with this exemplary aspect (and, if desired, other exemplary aspects) of the present invention, the compression connector can further comprise an anchor for fixing or anchoring the coil to the body such that the coil can flex in various directions but cannot rotate. Also, a collet can be disposed within the internal passageway of the body and adapted to receive the center conductor of the spiral corrugated coaxial cable and thereby establish electrical connectivity between the collet and the center conductor, and/or a spacer (e.g., an insulator) disposed between the collet and the body, the spacer engaging both the collet and the body and holding each apart from one another in a predetermined position whereby the center conductor is electrically isolated from the conductive corrugations and from the body.

In accordance with another exemplary aspect of the present invention, a compression connector comprises a body that defines an internal passageway and that includes a flanged proximal end and a distal end. A coiled element is located within the internal passageway of the body and is adapted for engagement within a groove of the spiral corrugated coaxial cable, wherein a clamping element is in communication with the coiled element. The connector further comprises a compression member having a proximal end, a distal end in tactile communication with the body, and a shoulder located between the proximal end and the distal end, as well as a driving member, which is located between a shoulder of the compression member and the clamping element. To connect the cable and the connector, the compression member is slidingly advanced in order for the shoulder of the compression member to contact and apply sufficient axial force to the driving member such that the driving member contacts the clamping element, thus, in turn, causing the clamping element to be compressed radially to an extent whereby the coiled element is driven into the groove of the spiral corrugated coaxial cable to provide at least one contact force between the compression connector and the spiral corrugated coaxial cable.

In accordance with yet another exemplary aspect of the present invention, a compression connector comprises a body that defines an internal passageway and that includes a flanged proximal end and a distal end, wherein a grommet is in tactile communication with the flanged proximal end. A coiled element is located within the internal passageway of the body and adapted for engagement within a groove of the spiral corrugated coaxial cable, wherein a clamping element is in communication with the coiled element. The connector further comprises a compression member having a proximal end, a distal end in tactile communication with the body, and a shoulder located between the proximal end and the distal end, as well as a driving member, which is located between a shoulder of the compression member and the clamping element. To connect the cable and the connector, the compression member is slidingly advanced such that contact forces are provided between the compression connector and the spiral corrugated coaxial cable due to at least (a) the grommet being compressed radially against the outer jacket of the spiral corrugated coaxial and (b) the shoulder of the compression member contacting and applying sufficient axial force to the driving member such that the driving member contacts the clamping element and causes the clamping element to be compressed radially to an extent whereby the coiled element is driven into the groove of the spiral corrugated coaxial cable.

Still other aspects, embodiments and advantages of the present invention are discussed in detail below. Moreover, it is to be understood that both the foregoing general description and the following detailed description are merely illustrative examples of the invention, and are intended to provide an overview or framework for understanding the nature and character of the invention as it is claimed. The accompanying drawings are included to provide a further understanding of the invention, and are incorporated in and constitute a part of this specification. The drawings illustrate various embodiments of the invention, and together with the description serve to explain the principles and operations of the invention.

BRIEF DESCRIPTION OF THE DRAWINGS

For a fuller understanding of the nature and desired objects of the present invention, reference is made to the following detailed description taken in conjunction with the accompanying figures, wherein like reference characters denote corresponding parts throughout the views, and in which.

DETAILED DESCRIPTION OF THE INVENTION

Figure 1:
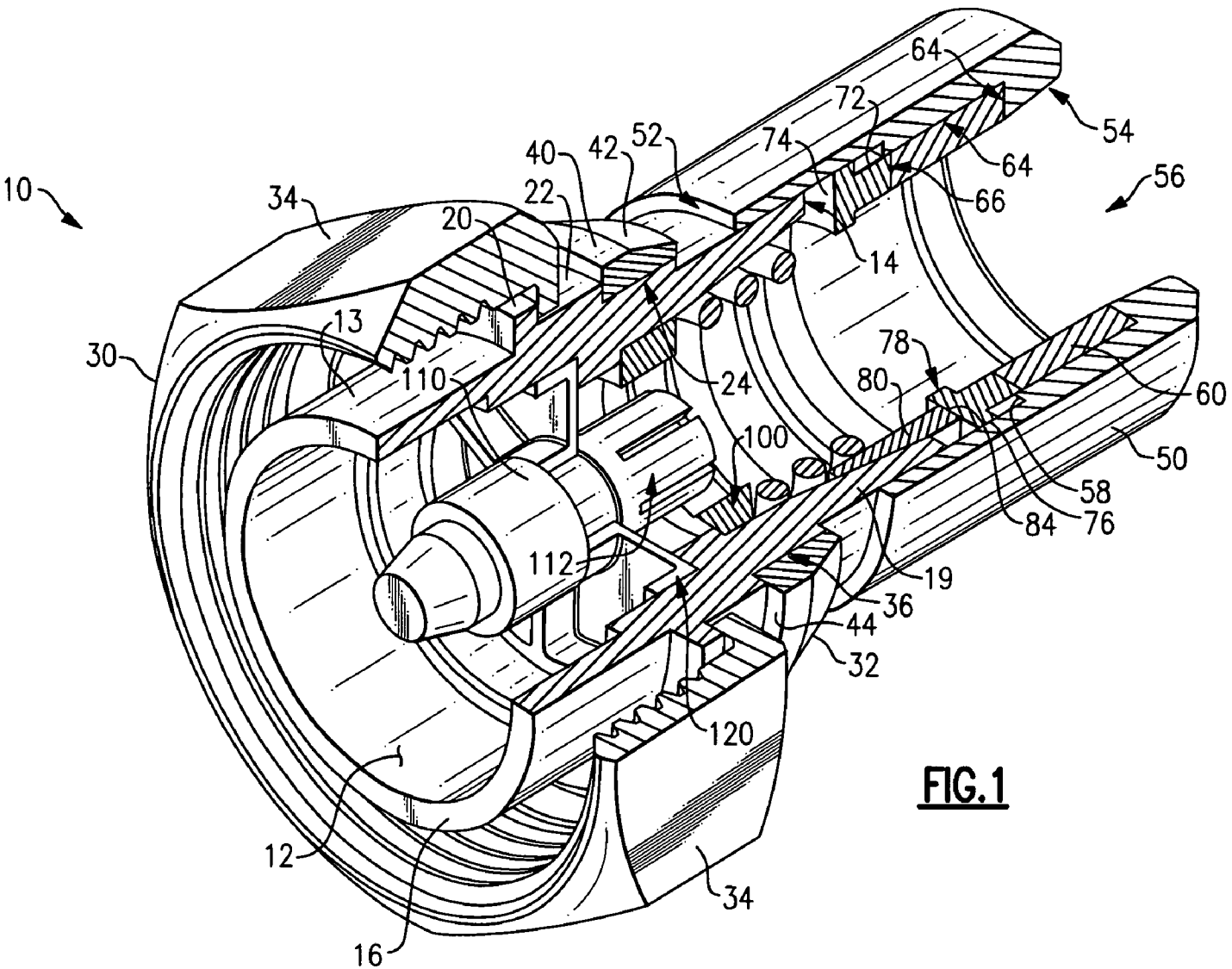
FIG. 1 is a cutaway perspective view of one embodiment of the present invention depicting the compression connector prior to the introduction of a spiral corrugated coaxial cable segment therewithin.
Figure 2:
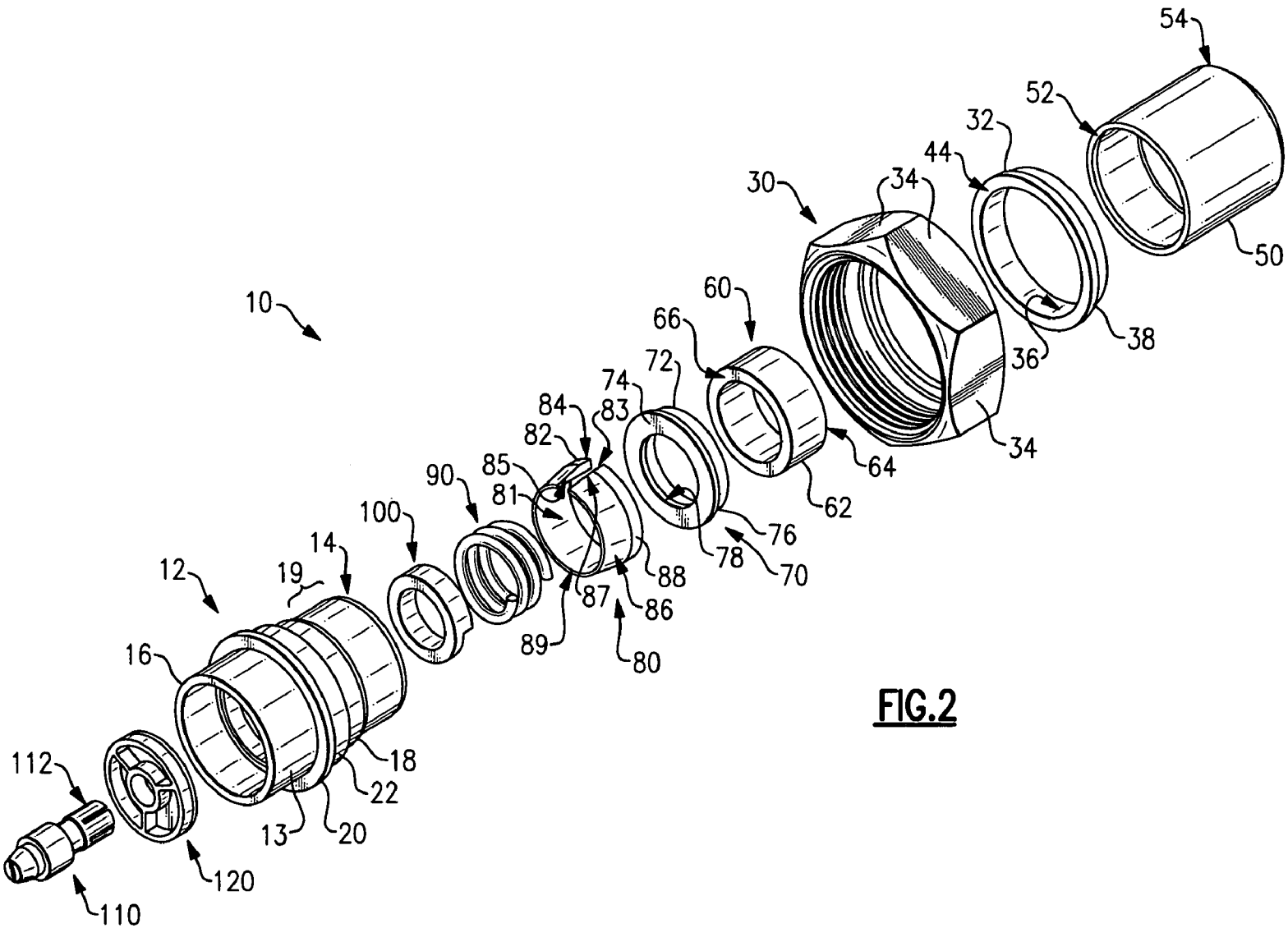
FIG. 2 is an exploded perspective view of the embodiment of the present invention shown in FIG. 1.

Referring initially to FIGS. 1 and 2, a compression connector 10 for spiral corrugated coaxial cable is illustrated. The compression connector 10 is advantageous in that it is simple to install in a factory or field setting and it is reliably effective at establishing and maintaining contact forces between the connector and the cable. Although the connector 10 is depicted in these figures as a DIN male connector interface, it is within the scope of the present invention for the connector to have other interfaces, including, but not limited to a BNC connector interface, a TNC connector interface, an F-type connector interface, an RCA-type connector interface, a DIN female connector interface, an N male connector interface, an N female connector interface, an SMA male connector interface, and an SMA female connector interface.

The compression connector 10 includes a connector body 12, which has a proximal end 14 and a distal end 16. In accordance with an exemplary embodiment of the present invention, and as shown, e.g., in FIG. 2, each of the proximal and distal ends 14, 16 of the connector body 12 has a substantially cylindrical shape. The connector body 12 also generally includes a first, proximal ridge 18, a surrounding ring 20 and a second, distal ridge 22, wherein the second ridge is located between the first proximal ridge and the surrounding ring.

Generally, the diameter of the connector body 12 is greater at the second ridge 22 than at the first proximal ridge. Moreover, as best illustrated by FIG. 1 and in accordance with an exemplary embodiment of the present invention, the inner diameter of the connector body 12 is reduced (i.e., tapers) at a taper area 19 of the connector body that generally spans between the first, proximal ridge 18 of the connector body and the proximal end 14 of the connector body.

As shown in FIG. 1, the distal end 16 of the connector body 12 is surrounded by a nut 30, which can be internally threaded. The nut 30 in retained within its illustrated position by the surrounding ring 20 of the connector body and through use of a nut retaining element 32 (e.g., a ring), which surrounds a portion of the connector body 12. Generally, the nut 30 is hex-shaped and includes a plurality of sides 34 to enable the nut to be grasped and manipulated by a tool (not shown) for use in coupling the connector 10 to a complimentary fitting (not shown).

The nut retaining ring 32 has an inner surface 36, which is in tactile communication with the connector body 12 and which, in accordance with an exemplary embodiment of the present invention, has a substantially constant diameter. The outer surface 38 of the nut retaining ring 32 generally includes a constant diameter portion 40 (see FIG. 1) and a ramped potion 42 (see FIG. 1) having a non-constant diameter. The top surface of 44 of the nut retaining ring generally is flat and also is in tactile communication with the connector body 12, e.g., with the second, distal ridge 22 of the connector body as shown in FIG. 1.

The proximal end 14 of the connector body is in tactile communication with a distal end 52 of a compression member 50 (e.g., a compression sleeve). The compression sleeve 50 also includes a shoulder 58 (see FIG. 1) and a proximal end 54, wherein the proximal end defines an opening 56 of the connector 10 into which a segment of spiral coaxial corrugated cable is inserted as will described in detail below.

As also depicted in FIG. 1, and in accordance with an exemplary embodiment of the present invention, the proximal end 54 of the compression sleeve 50 is flanged and a grommet 60 is in tactile communication with the one or more areas of the compression sleeve 50. By way of non-limiting example, and also as illustrated in FIG. 1, an outer surface 62 of the grommet 60 can be in communication with the compression sleeve 50 and the proximal end 64 of the grommet can be in communication with the flanged proximal end 54 of the compression sleeve.

A driving member (e.g., a washer) 70 is in tactile communication with both the compression sleeve 50 and the distal end 66 of the grommet 60, wherein the distal end of the grommet is opposite the proximal end 64 of the grommet. In accordance with an exemplary embodiment of the present invention, and as shown in FIG. 2, it is a cylindrical main body portion 72 of the driving member 70 that is in communication with the distal end of the grommet 60. The driving member 70 further includes a rim 74, which overlies the cylindrical body 72. The rim 74 has an outer circumferential surface 76 and an inner surface 78, wherein the outer surface is in tactile communication with the connector body 12 and has a diameter greater than that of the cylindrical body 72 of the driving member 70.

The connector 10 further includes a clamp element 80, which, in accordance with an exemplary embodiment of the present invention, has a wedge-like shape. The clamp 80 includes a first, proximal section 82 having a substantially constant diameter and a substantially flat proximal surface 84 which is in tactile communication with the rim 74 of the driving member 70. A second, distal section 86 of the clamp 80 has a non-constant outer diameter, which, by way of non-limiting example, is reduced (i.e., tapers) from the point 88 at which the first, proximal section intersects the second, distal section to the substantially flat top surface 89 of the clamp 80. As shown in FIG. 1, and in accordance with an exemplary embodiment of the present invention, the taper of the clamp 80 generally matches that of the proximal end of the connector body 12. As best shown in FIG. 2, the clamping element 80 further includes an interior bore 81 and, in accordance with an exemplary embodiment of the present invention, a discontinuity area 83 between a first end 85 and a second end 87 of the clamping element.

The clamp 80 surrounds a coiled element 90, which is disposed within the bore 81 of the clamp. The coiled element 90 is retained within the connector 10 in a manner whereby the coiled element can flex, elongate and/or stretch to accommodate variations in the size, shape and manufacturer of the inserted cable segment. Such retention can be accomplished as is generally known in the art, e.g., by molding the coiled element 90 into the anchor 100. The coiled element 90 can be in the form of a compression spring and can be formed of a variety of materials, e.g., a wire material.

Connector 10 also includes an anchor 100 to fix the coiled element 90 in place (e.g., anchored to the body 12) such that the coiled element can be flexed but not rotated. Connector body 12 also houses a collet 110 which is held in place by a spacer 120 (e.g., an insulator). A proximal end 112 of the collet 110 provides the connection to the center conductor of the inserted cable segment to which the connector 10 is being connected, whereas the insulator 90 electrically insulates the collet from the connector body 12 and the conductive portions of the inserted cable.

Figure 3A:
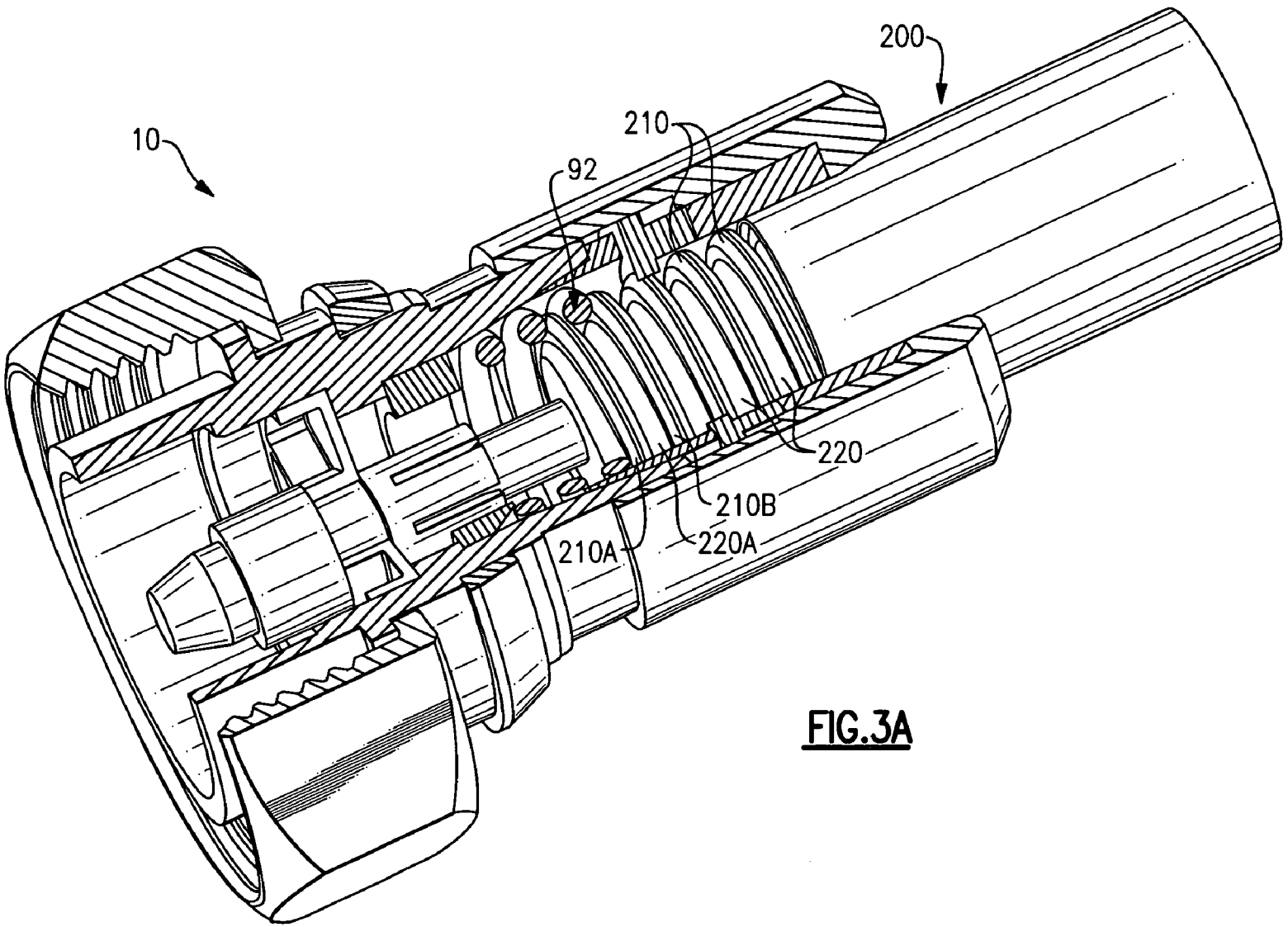
FIGS. 3A–3C are cutaway perspective views of the compression connector of FIG. 1 as a spiral corrugated coaxial cable segment is being introduced therewithin.

Referring now to FIG. 3A, the connector 10 of FIG. 1 is shown following the initial insertion of a segment of spiral corrugated coaxial cable 200. The cable segment 200 includes a plurality of corrugations 210, which, as shown, form a helical or spiral shape. A continuous groove 220 is formed between the corrugations 210, wherein the depth of the groove and the distance between provided by groove between each corrugation is selected to allow the coil element 90 to fit within the groove and engage the corrugations. As shown in FIG. 3A, and at this stage of insertion of the cable 200, a proximalmost turn 92 of the coiled element 90 is engaged within a distalmost segment 220A of the groove 220 between a distalmost corrugation 210A and an adjoining corrugation 210B of the cable.

Figure 3B:
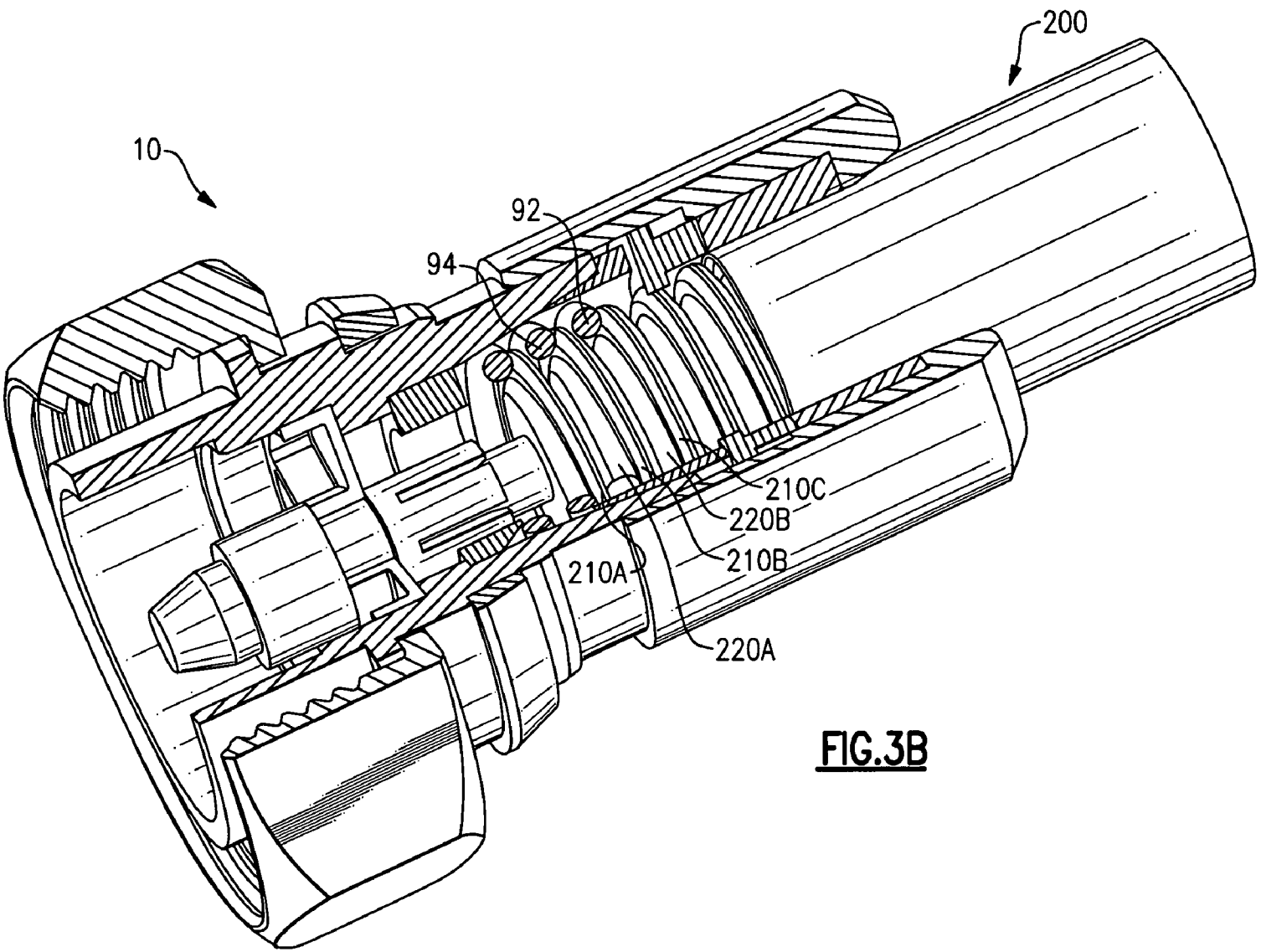

Upon further distal insertion of the cable 200 within the connector 10, and as shown in FIG. 3B, the proximalmost turn 92 of the coiled element 90 is disengaged from the distalmost segment 220A of the groove 220 and becomes engaged within the second most distal segment 220B of the groove 220 located between second most distal corrugation 210B and the third most distal corrugation 210C. As this occurs, a trailing turn 94 (i.e., the second most proximal turn) of the coiled element 90 becomes engaged within the distalmost segment 220A of the groove 220.

Figure 3C:
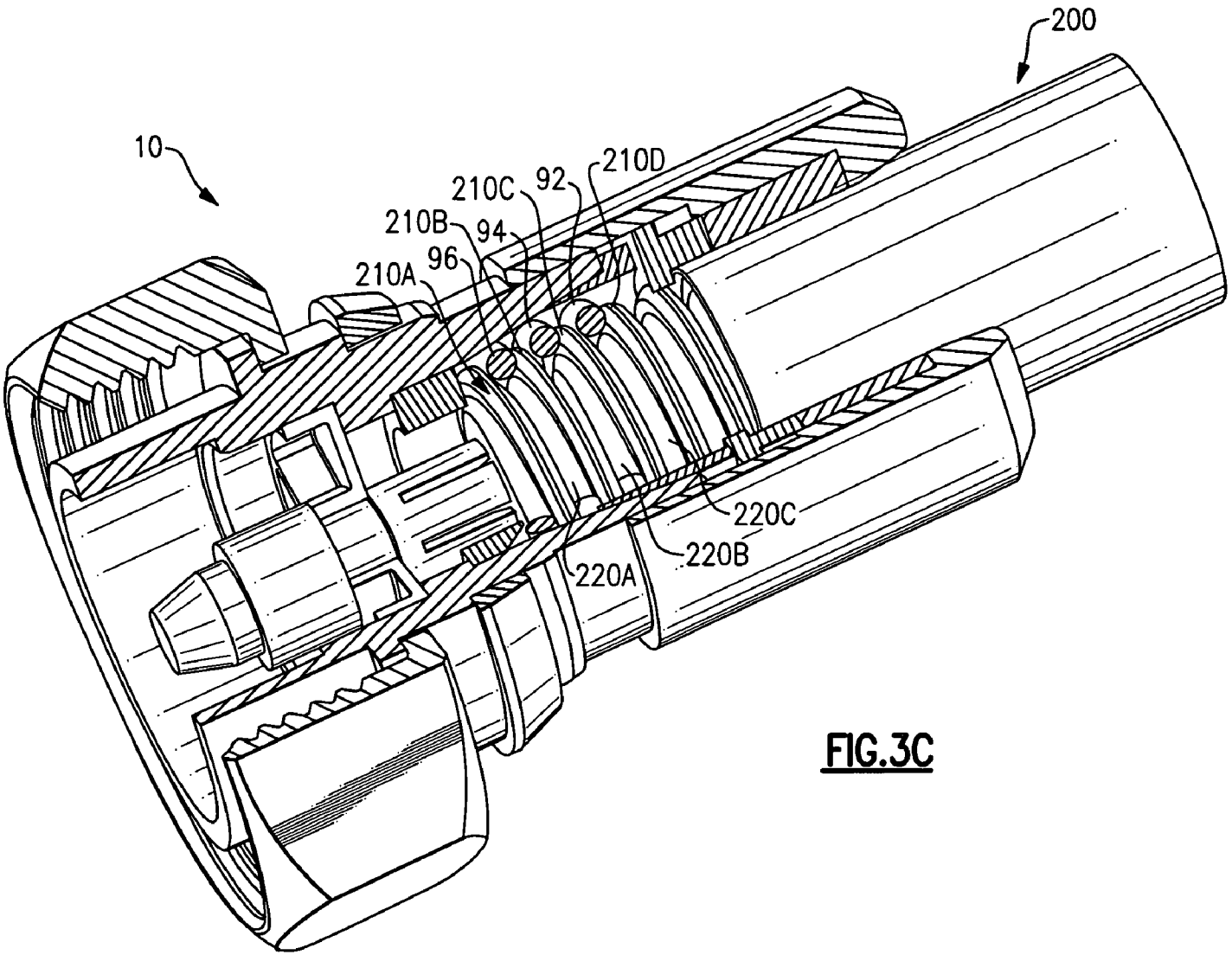

Upon still further distal insertion of the cable 200 within the connector 10, and as shown in FIG. 3C, the proximalmost turn 92 of the coiled element 90 is disengaged from the second most distal segment 220B of the groove 220 and becomes engaged within the third most distal segment 220C of the groove 220 located between the third most distal corrugation 210C and the fourth most distal corrugation 210D, whereas the first trailing turn 94 of the coiled element 90 is disengaged from the distalmost segment 220A of the groove 220 and becomes engaged within the second most distal segment 220B of the groove 220, and wherein a second trailing turn 96 (i.e., the third most proximal turn) of the coiled element 90 becomes engaged within the distalmost segment 220A of the groove 220.

Thus, as shown in FIGS. 3A–3C, as the cable 200 is inserted distally within the connector 10, the turns 92, 94, 96 of the coiled element 90 are engaged and disengaged, wherein turn 96 trails turn 94, which, in turn, trails turn 92. Therefore, turn 94 becomes engaged within the distalmost segment 220A of the groove 220 once turn 92 is disengaged therefrom, and turn 96 becomes engaged within the distalmost segment 220A of the groove 220 once turn 94 is disengaged therefrom. Similarly, turn 94 becomes engaged within the second most distal segment 220B of the groove 220 once turn 92 is disengaged therefrom, and turn 96 becomes engaged within the second most distal segment 220B of the groove 220 once turn 94 is disengaged therefrom.

After the spiral corrugated coaxial cable segment 200 has been fully inserted within the connector 10, and in accordance with an exemplary embodiment of the present invention, a tool (not shown) is utilized to engage the compression sleeve 50 and a distal portion 13 (see FIG. 1) of the connector body 12. The tool applies compressive force onto the connector body 12 while, at the same time, applying axial force sufficient to cause the compression sleeve 50 to move axially in a distal direction. The axial movement of the compression sleeve is shown by FIG. 4, wherein the distal end 52 of the compression sleeve 50 has moved distally along the proximal taper area 19 of the connector body 12 as compared to its position in FIGS. 1, 3A, 3B and 3C.

It should be noted that other techniques and/or equipment can be utilized as is generally known in the art to engage the connector body and axially move the compression sleeve 50 in a distal direction. Moreover, in accordance with an alternative embodiment of the present invention, the compression sleeve 50 can include internal threads and the proximal area 19 of the connector body 12 can include external threads such that the compression sleeve can be threadedly moved in a distal direction axially along the proximal area 19 of the connector body 12.

According to an exemplary embodiment of the present invention, the grommet 60 is made of a material (e.g., rubber) that is less hard than the material (e.g., a metal-based material) from which the driving member 70 is made. Thus, as the compression sleeve 50 is moved distally, the flanged proximal end 54 causes the comparatively softer grommet 60 to be pressed against and, in turn, compressed by the comparatively harder driving member 70. As this occurs, the grommet 60 exerts radial compressive force against the outer jacket 202 of the cable segment 200. That, in turn, provides a contact force between the connector 10 and the cable 200 while also beneficially allowing for some degree of flexure of the cable without causing kinking or other damage to the cable.

Figure 4:
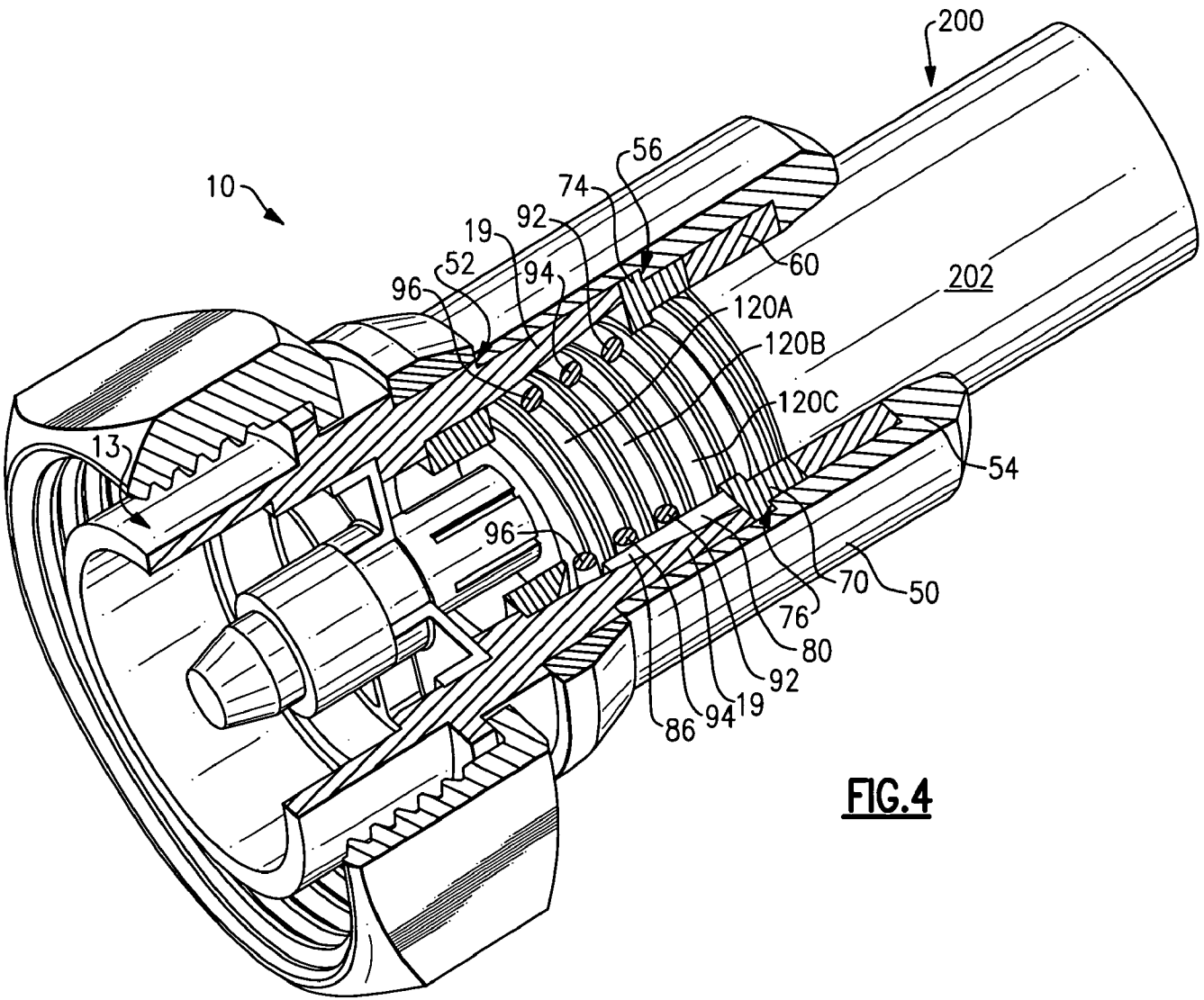
FIG. 4 is a cutaway perspective view of the compression connector of FIG. 1 with a compressed spiral corrugated coaxial cable segment therewithin.

As shown in FIG. 4, distal movement of the compression sleeve 50 causes the shoulder 56 of the compression sleeve to contact the outer surface 76 of the rim 74 of the driving member 70, thus causing the rim to move axially in a distal direction. That, in turn, causes the rim 74 to exert an axial force against the clamping element 80 such that the tapered distal section 86 of the clamping element 80 is driven into/against the tapered proximal area 19 of the connector body 12. As a result, pressure is exerted by the connector body 12 against the clamping element 80 such that, although not shown in the drawings, the diameter of the internal bore 81 of the clamping element 80 is reduced and the first end 85 and the second end 87 of the clamping element are caused to be brought together to an extent whereby the discontinuity area 83 of the clamping element is either reduced or eliminated entirely. As this occurs, the clamping element 80 clamps down upon (i.e., is squeezed against) the coil element 90, thus causing the turns 92, 94, 96 of the coil element to be driven tightly into the segments 220A, 220B, 220C of the groove 220 of the cable 200 in order to beneficially create a plurality of strong contact surfaces between the coil element 90 and the cable.

Thus, the present invention provides a connector 10 that beneficially exerts strong contact forces within the groove segments 220A, 220B, 220C of the groove 220 between the corrugations 210 of the cable 200, as well as an additional contact force between the grommet 60 on the jacket 202 of the cable. This "belt-and-suspenders" approach is simple to implement in either a factory or field installation setting, and provides assurance that contact forces will remain in place such that proper mechanical and electrical connections between connected cable segments can be properly maintained.

Although the present invention has been described herein with reference to details of currently preferred embodiments, it is not intended that such details be regarded as limiting the scope of the invention, except as and to the extent that they are included in the following claims—that is, the foregoing description of the present invention is merely illustrative, and it should be understood that variations and modifications can be effected without departing from the scope or spirit of the invention as set forth in the following claims. Moreover, any document(s) mentioned herein are incorporated by reference in their entirety, as are any other documents that are referenced within the document(s) mentioned herein.

I claim:

1. A spiral corrugated coaxial cable compression connector, the coaxial cable having a center conductor surrounded by a dielectric layer, the dielectric layer being surrounded by a plurality of conductive corrugations, wherein a continuous groove is defined between the corrugations, and wherein the corrugations are at least partially surrounded by a protective outer jacket, the compression connector comprising:

a body defining an internal passageway and including a proximal end and a distal end;

a compression member having a proximal end and a distal end, wherein the distal end of the compression member is in tactile communication with the body;

a coiled element within the internal passageway of the body and adapted for engagement within the groove;

a clamping element in communication with the coiled element, whereby upon sliding advancement of the compression member the clamping element is caused to be compressed radially to an extent whereby the coiled element is driven into the groove so as to provide at least one contact force between the compression connector and the spiral corrugated coaxial cable;

a driving member located between a shoulder of the compression member and the clamping element, whereby upon sliding advancement of the compression member the shoulder contacts and applies sufficient axial force to the driving member such that the driving member contacts the clamping element and causes the clamping element to be compressed radially to an extent whereby the coiled element is caused to be driven into the groove so as to provide at least one contact force between the compression connector and the spiral corrugated coaxial cable.

2. The compression connector of claim 1, wherein at least a portion of the body is tapered and wherein at least a portion of the clamping element has a substantially matching taper.

3. The compression connector of claim 1, wherein the proximal end of the compression member is flanged.

4. The compression connector of claim 3, further comprising a grommet in tactile communication with the flanged proximal end of the compression member, whereby upon sliding advancement of the compression member the grommet is compressed radially against the protective outer jacket of the spiral corrugated coaxial to provide a contact force between the compression connector and the spiral corrugated coaxial cable.

5. The compression connector of claim 4, wherein the grommet is made of rubber.

6. The compression connector of claim 5, wherein the distal end of the body includes a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector.

7. The compression connector of claim 1, wherein the driving member is a washer.

8. The compression connector of claim 1, further comprising an anchor for anchoring the coiled element in place.

9. The compression connector of claim 8, wherein the spacer is an insulator.

10. The compression connector of claim 1, further comprising a collet disposed within the internal passageway of the body and adapted to receive the center conductor of the spiral corrugated coaxial cable and thereby establish electrical connectivity between the collet and the center conductor.

11. The compression connector of claim 10, further comprising a spacer disposed between the collet and the body, the spacer engaging both the collet and the body and holding each apart from one another in a predetermined position whereby the center conductor is electrically isolated from the conductive corrugations and from the body.

12. The compression connector of claim 1, wherein the clamping element includes an internal bore having a predetermined diameter, and wherein the coiled element is at least partially disposed within the internal bore.

13. The compression connector of claim 12, wherein the clamping element further includes a first end, a second end, and a discontinuity area between the first end and the second end, and wherein the discontinuity area is reduced as the clamping element is compressed radially such that the diameter of the internal bore is reduced to an extent whereby the coiled element is caused to be driven into the groove so as to provide at least one contact force between the compression connector and the spiral corrugated coaxial cable.

14. A spiral corrugated cable compression connector, the coaxial cable having a center conductor surrounded by a dielectric layer, the dielectric layer being surrounded by a plurality of conductive corrugations, wherein a continuous groove is defined between the corrugations, and wherein the corrugations are at least partially surrounded by a protective outer jacket, the compression connector comprising:

a body defining an internal passageway and including a flanged proximal end and a distal end;

a compression member having a proximal end, a distal end in tactile communication with the body, and a shoulder located between the proximal end and the distal end;

a coiled element within the internal passageway of the body and adapted for engagement within the groove;

a clamping element in communication with the coiled element; and a driving member located between a shoulder of the compression member and the clamping element, whereby upon sliding advancement of the compression member the shoulder of the compression member contacts and applies sufficient axial force to the driving member such that the driving member contacts the clamping element and causes the clamping element to be compressed radially to an extent whereby the coiled element is driven into the groove to provide at least one contact force between the compression connector and the spiral corrugated coaxial cable.

15. The compression connector of claim 14, wherein the proximal end of the compression member is flanged, further comprising a grommet in tactile communication with the flanged proximal end of the compression member, whereby upon sliding advancement of the compression member the grommet is compressed radially against the protective outer jacket of the spiral corrugated coaxial to provide a contact force between the compression connector and the spiral corrugated coaxial cable.

16. The compression connector of claim 15, wherein the grommet is made of rubber.

17. The compression connector of claim 14, wherein at least a portion of the body is tapered and wherein at least a portion of the clamping element has a substantially matching taper.

18. The compression connector of claim 14, wherein the grommet is made of rubber.

19. The compression connector of claim 14, further comprising an anchor for anchoring the coiled element in place.

20. The compression connector of claim 14, further comprising a collet disposed within the internal passageway of the body and adapted to receive the center conductor of the spiral corrugated coaxial cable and thereby establish electrical connectivity between the collet and the center conductor.

21. The compression connector of claim 20, further comprising a spacer disposed between the collet and the body, the spacer engaging both the collet and the body and holding each apart from one another in a predetermined position whereby the center conductor is electrically isolated from the conductive corrugations and from the body.

22. The compression connector of claim 21, wherein the spacer is an insulator.

23. The compression connector of claim 14, wherein the clamping element includes an internal bore having a predetermined diameter, and wherein the coiled element is at least partially disposed within the internal bore.

24. The compression connector of claim 23, wherein the clamping element further includes a first end, a second end, and a discontinuity area between the first end and the second end, and wherein the discontinuity area is reduced as the clamping element is compressed radially such that the diameter of the internal bore is reduced to an extent whereby the coiled element is caused to be driven into the groove so as to provide at least one contact force between the compression connector and the spiral corrugated coaxial cable.

25. The compression connector of claim 14, wherein the distal end of the body includes a connector interface selected from the group of connector interfaces consisting of a BNC connector, a TNC connector, an F-type connector, an RCA-type connector, a DIN male connector, a DIN female connector, an N male connector, an N female connector, an SMA male connector and an SMA female connector.

26. A spiral corrugated cable compression connector, the coaxial cable having a center conductor surrounded by a dielectric layer, the dielectric layer being surrounded by a plurality of conductive corrugations, wherein a continuous groove is defined between the corrugations, and wherein the corrugations are at least partially surrounded by a protective outer jacket, the compression connector comprising:

a body defining an internal passageway and including a flanged proximal end and a distal end;

a compression member having a proximal end, a distal end in tactile communication with the body, and a shoulder located between the proximal end and the distal end;

a grommet in tactile communication with the flanged proximal end of the compression member;

a coiled element within the internal passageway of the body and adapted for engagement within the groove;

a clamping element in communication with the coiled element; and a driving member located between a shoulder of the compression member and the clamping element, whereby upon sliding advancement of the compression member contact forces are provided between the compression connector and the spiral corrugated coaxial cable due to at least:

(a) the grommet being compressed radially against the outer jacket of the spiral corrugated coaxial; and (b) the shoulder of the compression member contacting and applying sufficient axial force to the driving member such that the driving member contacts the clamping element and causes the clamping element to be compressed radially to an extent whereby the coiled element is driven into the groove.

* * * * *